United States Patent [19]

Kummunsalo

[11] Patent Number: 4,856,546

[45] Date of Patent: Aug. 15, 1989

[54] ARRANGEMENT FOR UMBRELLA

[76] Inventor: Pentti Kummunsalo, Jännetie 1 E 34 B, SF-00370 Helsinki, Finland

[21] Appl. No.: 157,805

[22] Filed: Feb. 19, 1988

[30] Foreign Application Priority Data

Feb. 27, 1987 [FI] Finland ..... 870854

[51] Int. Cl.[4] ..... A45B 11/00

[52] U.S. Cl. ..... 135/20 R; 135/76

[58] Field of Search ..... 135/16, 20 R, 65, 66, 135/76

[56] References Cited

U.S. PATENT DOCUMENTS

| | | | |
|---|---|---|---|
| 250,328 | 11/1881 | Hughes | 135/65 |
| 976,638 | 11/1910 | Corey | 135/65 |
| 2,211,283 | 8/1940 | Mercer | 135/20 R |
| 2,223,253 | 11/1940 | Hamilton . | |
| 3,021,985 | 2/1962 | Sarver . | |
| 3,765,434 | 10/1973 | Riggs . | |
| 4,121,605 | 10/1978 | Schmerl . | |
| 4,358,138 | 11/1982 | Laughlin et al. | 135/66 X |
| 4,527,311 | 7/1985 | Aoki | 24/303 |

FOREIGN PATENT DOCUMENTS

| | | |
|---|---|---|
| 247668 | 2/1926 | United Kingdom . |
| 2044610 | 10/1980 | United Kingdom . |
| 2089206 | 6/1982 | United Kingdom . |
| 2172220 | 9/1986 | United Kingdom . |

*Primary Examiner*—Henry E. Raduazo

*Attorney, Agent, or Firm*—Merchant, Gould, Smith, Edell, Welter & Schmidt

[57] ABSTRACT

The invention relates to an arrangement for an umbrella or a corresponding means. The umbrella is referred to as a portable means giving shelter mainly against rain or sun, which comprises an elongated body, a shelter cover attached to the body, which can be typically gathered around the body and put up around one end of the body, and a handle situated at the other end of the body. The arrangement according to the invention comprises an arm and a fixing device by means of which the arm can be attached to the body so that it preferably situates at right angles to the longitudinal axis of the body in the working position. The arm is provided with a folding means in the fixing device so that the arm can be folded down in the direction of the longitudinal axis of the body in the carrying position.

9 Claims, 2 Drawing Sheets

ARRANGEMENT FOR UMBRELLA

BACKGROUND OF THE INVENTION

This invention relates to an arrangement for an umbrella or a corresponding means, which is referred to as a portable means giving shelter mainly against rain or sun, which umbrella comprises an elongated body, a shelter cover attached to the body, which shelter cover can be typically gathered around the body and put up around one end of the body, and a handle situated at the other end of the body.

In typical use the handle of the umbrella is held to by at least one hand so, that the body stands practically vertically and the shelter cover stays above one's head. Such actions, which demand both hands to be used, are difficult or impossible to perform. Then the umbrella will fall down or will be let down against one's head and the body will be placed under one's arm. As an example of the circumstances, where both hands are needed, can be mentioned for instance recording results on a card during golfing, cleaning a golf ball or a golf club, applauding to fine performances in various athletic contents, paying one's purchases at the market, and opening a locked door by turning the key and pulling the door handle.

SUMMARY OF THE INVENTION

An object of the invention is, among other things, to avoid the aforementioned disadvantage, and to relieve at least temporarily both hands when using an umbrella e.g. to perform the aforementioned actions. In order to accomplish this an arrangement according to the invention comprises an arm and a fixing device by means of which the arm can be attached to the body of an umbrella practically at right angles to a longitudinal axis of the body in the working position. The characteristic features of the invention can be found in the attached claims.

Advantages of the invention are, for instance, first of all an effective elimination of the aforementioned drawback, a simple structure, a possibility to join the arrangement afterwards to already finished umbrellas, and the fact that the arrangement doesn't disturb the normal use of an umbrella.

BRIEF DESCRIPTION OF THE INVENTION

In the following the invention will be described in detail with reference to the accompanying drawings, in which FIG. 1 shows an umbrella with an arrangement according to the invention;

DESCRIPTION OF THE PREFERRED EMBODIMENT

Figure 1:
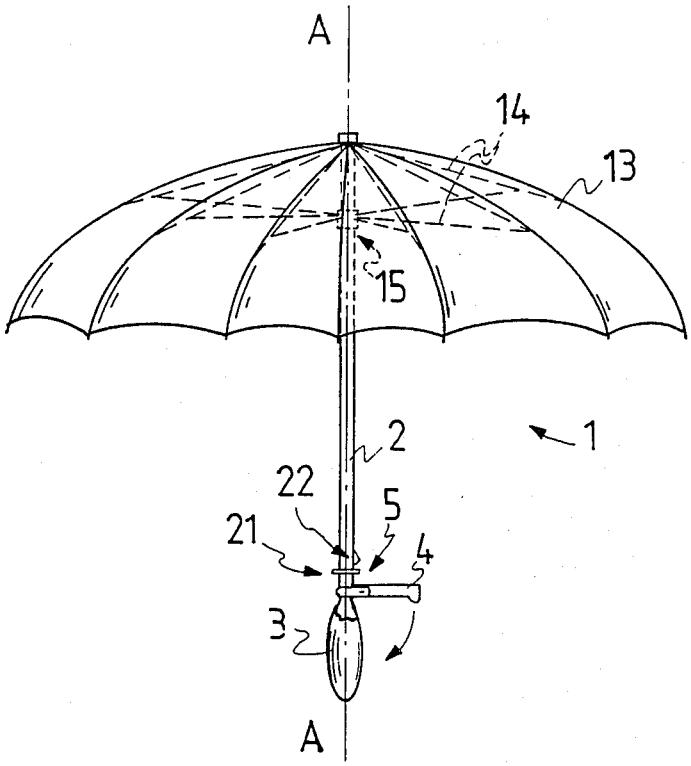

An umbrella 1 or a corresponding portable shelter comprises an elongated body 2, such as a tubular body, a shelter cover 13 attached to one end of the body 2, and preferably a handle 3 fitted to the other end of the body 2 (FIG. 1). Typically, the shelter cover 13 is secured by pins 14 to a sleeve 15, which is arranged to move along the body 2 and which can be locked up in an upper and a lower position. Thus the shelter cover can be gathered around the body 2 by means of the sleeve, when the umbrella is not in use, and put up around the other end of the body 2, when the umbrella is in use.

An arrangement according to the invention comprises an arm 4 and a fixing device 5 by means of which the arm 4 can be attached to the body 2 preferably to lie practically at right angles to a longitudinal axis A—A of the body 2 in the working position. The arm 4 is an elongated object having a lenght of e.g. about 10 to 15 cm.

The arrangement of the invention is preferably attached to the body area lying between a shelter fitting 21 and a sleeve locking device 22 and the handle 3. Independent of the fitting 21 or the locking device 22, if being provided, it can be also attached to any suitable part of the body 2 above the handle 3.

The arm 4 is provided with a folding means preferably in the fixing device 5, so that the arm can be folded to lie in the direction of the longitudinal axis A—A of the body 2. When the arm 4 lies perpendicularly to the body 2 the arrangement is in the working position, and when the arm 4 is folded in the direction of the longitudinal axis of the body 2 the arrangement is in a carrying position.

Figure 2:
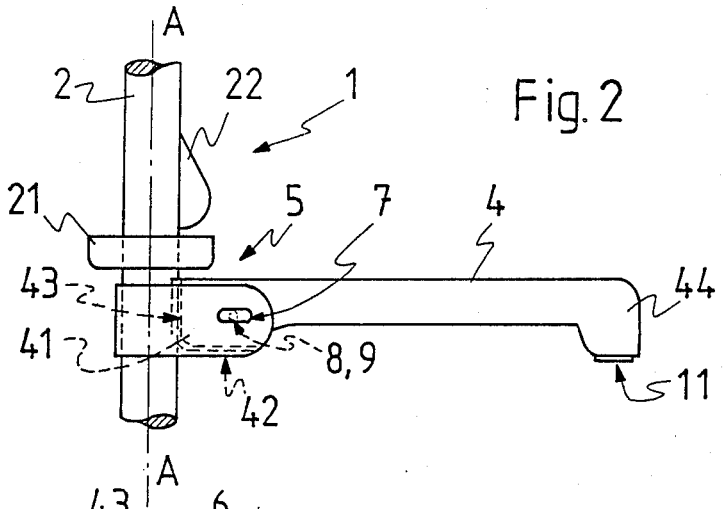
FIG. 2 shows an arrangement of the invention jointed to an umbrella body in the working position, as a side view.
Figure 3:
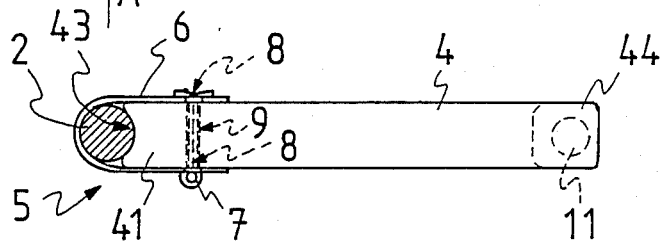
FIG. 3 shows the arrangement of FIG. 2 in the working position, seen from above.
Figure 4:
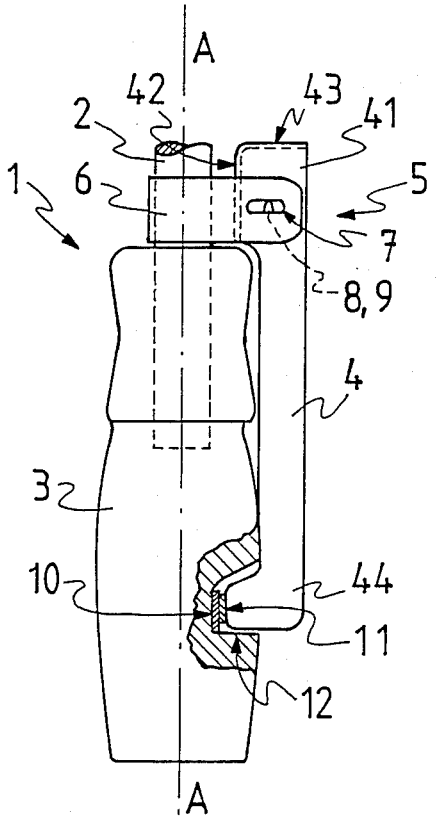
FIG. 4 shows the arrangement of FIG. 2 in the carrying position, as a side view.

The fixing device 5 includes a collar 6 and a pin 7 such as a cotter pin, a center pin, a screw, brackets bent from the collar, or the like. This kind of the fixing device serves as a folding means, too. In an embodiment of the invention according to the drawings, the collar 6 is provided with holes 8. The arm 4 is provided with a hole 9 or recesses on both sides of the arm. The collar 6 is placed around the body 2 and fixed by the pin 7 to the arm 4 through the holes 8, 9 (FIGS. 2, 3 and 4).

The collar 6 is fastened to the arm 4 by means of the pin 7 so, that the fixing point of the pin i.e. in this case the hole 9 is situated at a greater distance from the first end 41 of the arm close to the body of the umbrella than from its lower surface 42. The first end 41 of the arm 4 thus form an eccentric-like object having its centre just on the hole 9. The arm 4 and the collar 6 then is locked up in the working position (FIGS. 2 and 3) as a result of collaboration of the arm 4, the collar 6, and the body 2. When the arm 4 is folded down around the pin 7 to the carrying position (FIG. 4), the collar 6 is released and the arrangement can be easily moved along the body 2, and it can be located to the part of the body 2, where it doesn't disturb the normal use or carryiny of the umbrella. In addition, to the first end 41 of the arm 4 there is arranged a groove 43 in accordance with the diameter of the body 2 of the umbrella. Best locking up of the arm 4 to the body 2 is accordingly ensured in the working position.

It is preferable that the arrangement further comprises a locking device by means of which the arm can be locked to the body 2 or the handle 3 in the carrying position. So it is not allowed to disturb the typical use, carrying or storing of the umbrella. The locking device comprises a piece of magnet and a counterpart such as a piece of iron, which are located apart in connection with the arm and the body. This can be realized e.g. by providing the body, preferably the handle 3, with a piece of magnet 10, and the other end 44 of the arm 4 with a magnet counterpart 11, or vice versa. When the arm is folded against the handle 3 the magnet 10 and its counterpart 11 will meet and be locked to each other.

Thus the arm 4 is kept at its location in the carrying position. The handle 3 can be provided with a spesific hole 12, into which the magnet 10 is located.

The locking of the arrangement of the invention in the carrying position can also be realized on the basis of the design or the resilience of the arm or in some other corresponding manner.

The arrangement of the invention operates as follows. When for example an outer door is to be opened and because of a rain one doesn't want to lay aside or fold up the umbrella, the arm 4 of the arrangement is turned from the carrying position (FIG. 4) to the working position (FIG. 2) and at the same time located at the suitable part in the body 2. Then the umbrella can be lowered supported by the arm 4 to rest against one's arm, whereat the shelter cover remains up and gives shelter against rain as usually, but both hands are free to turn the key and pull the door handle. When the door has been opened the arm 4 is folded to lie in the direction of the body 2 in the carrying position.

Primarily, the invention has been described above with reference to one preferred embodiment. It is obvious that the invention by no means is meant to be limited to concern only to that embodiment. So many variations can be made to the above embodiment within the scope of the invention. For instance, the fixing device 5 can as well be of some other type than the one described herein. The arm 4 and the fixing device 5 can form a solid and rigid unit, which is provided with a hole for the body 2 of the umbrella, and e.g. laterally attachable to the body as well as detachable from it. Then it is not at all necessary to fold the arm 4 to be in line with the body 2.

I claim:

1. An improved umbrella, of the type having an elongated body, a shelter cover attached to one end of the body, said shelter cover adapted to be gathered around the body and put up around one end of the body in use, and a handle situated at a second opposite end of the body, wherein the improvement comprises:

(a) a fixing device including a collar mounted about said body and a pin mounted in said collar:

(b) an arm having first and second opposite ends, said arm pivotally attached to said pin at a fixing point, said fixing point closer to said lower surface of said arm than to said first end of said arm such that the first end of the arm includes an eccentric-like object with said fixing point, said arm being pivotal about said fixing point between a first carrying position and a second working position, such that in said working position said arm is supported substantially perpendicular to said umbrella body and said arm first end abuts said body preventing linear displacement of said arm with respect to said body by means of said eccentric-like object as a result of collaboration of the arm, the collar and the body of the umbrella and said arm being substantially parallel to said umbrella body in said carrying position, and said fixing device movable along said body.

2. An arrangement according to claim 1, wherein the arm is provided with a folding means in the fixing device so that the arm can be folded in the direction of the longitudinal axis of the body in the carrying position.

3. An arrangement according to claim 2, wherein the arrangement further comprises a locking device by means of which the arm is locked in the carrying position.

4. An arrangement according to claim 3, wherein the locking device comprises a piece of magnet and a counterpart which are located apart in the connection with the arm and the body.

5. An arrangement according to claim 4, wherein the handle is provided with a piece of magnet and the other end of the arm is provided with the counterpart.

6. An improved umbrella according to claim 1, wherein said arm first end includes a groove abutting said umbrella body when said arm is in said working position.

7. An umbrella according to claim 1, wherein the improvement further comprises a locking device releasably attaching said arm to said handle in said carrying position.

8. An umbrella according to claim 7, wherein said locking devices includes a magnet part mounted on said arm and a magnet counterpart mounted on said handle.

9. An improved umbrella, of the type having an elongated body, a shelter cover attached to one end of the body, said shelter cover adapted to be gathered around the body and put up around one end of the body, and a handle at a second opposite end of the body, wherein the improvement comprises:

(a) a fixing device including a collar mounted about said body and a pin mounted in said collar; and (b) an arm having first and second opposite ends and a lower surface, said arm attached to said fixing device pin at a fixing point nearer said lower surface than to said first end, said arm pivotal about said pin between a first carrying position and a second working position; said arm, in said carrying position, being generally parallel to said umbrella body with said first arm end nearer said umbrella body first end than is said second arm end; said arm, in said working position, being supported substantially perpendicular to said umbrella body with said arm first end abutting said umbrella body preventing linear displacement of said collar and preventing further rotation of said arm about said pin.

* * * * *